United States Patent [19]

Price

[11] 4,098,559

[45] Jul. 4, 1978

[54] PAIRED BLADE ASSEMBLY

[75] Inventor: Jerry Lee Price, Lake Park, Fla.

[73] Assignee: United Technologies Corporation, Hartford, Conn.

[21] Appl. No.: 708,680

[22] Filed: Jul. 26, 1976

[51] Int. Cl.[2] ..... F01D 5/30

[52] U.S. Cl. ..... 416/230; 416/212 A; 416/218; 416/241 A; 416/248

[58] Field of Search ..... 416/218, 230, 229, 229 A, 416/241 A, 212, 212 A, 248

[56] References Cited

U.S. PATENT DOCUMENTS

| | | | |
|---|---|---|---|
| 1,362,074 | 12/1920 | Baumann | 416/214 A |
| 2,868,439 | 1/1959 | Hampshire et al. | 416/230 X |
| 2,929,755 | 3/1960 | Porter | 416/230 X |
| 3,501,090 | 3/1970 | Stoffer et al. | 416/218 X |
| 3,549,444 | 12/1970 | Katz | 416/230 X |
| 3,556,675 | 1/1971 | Howald et al. | 416/230 X |
| 3,632,460 | 1/1972 | Palfreyman et al. | 416/241 A X |
| 3,694,104 | 9/1972 | Erwin | 416/230 X |
| 3,758,232 | 9/1973 | Wallett | 416/213 |
| 3,883,267 | 5/1975 | Baudier et al. | 416/230 |
| 3,942,231 | 3/1976 | Whitaker | 416/230 X |
| 4,022,547 | 5/1977 | Stanley | 416/230 |
| 4,037,988 | 7/1977 | Laird | 416/230 X |
| 4,043,703 | 8/1977 | Carlson | 416/230 |

FOREIGN PATENT DOCUMENTS

| | | | |
|---|---|---|---|
| 944,645 | 6/1956 | Fed. Rep. of Germany | 416/214 |
| 711,703 | 7/1954 | United Kingdom | 416/215 |
| 901,075 | 7/1962 | United Kingdom | 416/230 |
| 274,300 | 9/1970 | U.S.S.R. | 416/230 |

*Primary Examiner*—Everette A. Powell, Jr.
*Attorney, Agent, or Firm*—Robert C. Walker

[57] ABSTRACT

A rotor blade system which is adaptd for long term reliable operation in a gas turbine engine is disclosed. Techniques incorporating composite materials into the rotor system are developed. One rotor structure shown utilizes a paired blade assembly having a core of continuous fibers running from the tip of one blade to the tip of the adjacent blade. Each of said paired blade assemblies is mchanically detachable from the engine rotor.

2 Claims, 6 Drawing Figures

FIG. 5
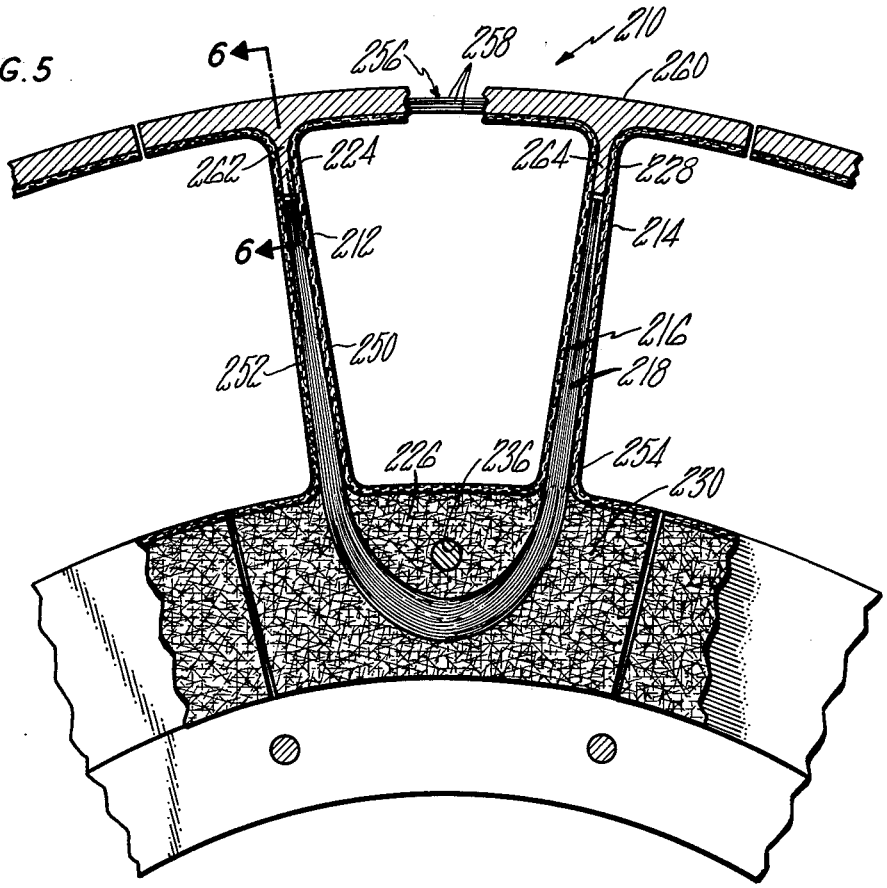
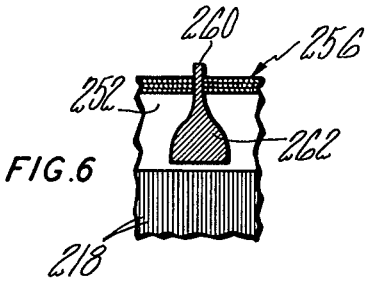
FIG. 6

PAIRED BLADE ASSEMBLY

DESCRIPTION OF THE PRIOR ART

1. Field of the Invention

This invention relates to gas turbine engines and more particularly to the fan and compressor blades of a gas turbine engine.

2. Background of the Invention

Scientists and engineers in the gas turbine engine field have long recognized that reducing the weight of engine components without altering aerodynamic or structural characteristics increases the performance ratings of the engine in which the components are installed. Similarly, increasing the rotor speed while avoiding a weight increase in the engine components also produces performance rating improvements.

Conventional techniques for increasing the rotor speed employing traditional materials have necessitated corresponding increases in the weight of the rotor blades. As the rotor speed is increased the blades become increasingly susceptible to torsional deformation as a result of increased gas pressure loading on the blades and as a result of increased centrifugally generated forces. Similarly, as the span of the blades is increased in correspondence to an increased flow path area, the gas pressure loading and the centrifugally generated forces also increase. Blade resistance to torsional deformation can be maintained by increasing the stiffness of the rotor blades. Increasing the stiffness, however, requires additional blade material and necessitates corresponding weight increases throughout the rotor system to absorb the increased centrifugally generated forces. Suitable materials having increased strength to weight ratios are sought.

Recent advances in composite materials technology have focused considerable attention upon the use of these materials in fan and compressor blades of gas turbine engines. U.S. Pat. Nos. 3,501,090 to Stoffer et al entitled "Composite Bladed Rotors" and 3,737,250 to Pilpel et al entitled "Fiber Blade Attachment" are considered representative of prior art composite blading techniques.

Composite materials are known to have high strength to weight ratios in tension and nearly all prior art composite systems have proposed a spanwise extending core of fibers in the blades of the rotor assembly. In Pilpel et al, for example, each blade has one or more fiber bundles which are wound around a pin in the root of each individual blade. The bend radius of the fibers in the root region is necessarily small in order to be contained within the geometric confines of the root. The small bend radii of the fibers encourages the buildup of excessive shear stresses in the fibers and, accordingly, limits the strength and durability of the blade system.

Stoffer et al discloses an integrally formed, composite disk and blade assembly wherein the fibers of each core extend through a central disk and then radially through another blade. The bend radii are large and the shear stresses in the fibers are relatively low. The fabrication of this and similar integrally formed structures, however, is expensive. Collaterally, any damage, as by the ingestion of foreign objects into the blade system during the operation of the engine in which the system is installed, necessitates repair or replacement of the entire disk and blade assembly. The replacement of such a large and intricate component, possibly for even minor damage, is considered by most engine operators to be expensive and time consuming, and therefore a design of limited commercial potential.

Although composite materials do hold great promise for use in high performance engines, the use of structures incorporating these materials has been plagued by the problems discussed above. New techniques are continually being sought for allowing composite material use in gas turbine engines to obtain its full potential.

SUMMARY OF THE INVENTION

A primary object of the present invention is to improve the overall performance of a gas turbine engine. An increase in the allowable rotor blade tip speed and a decrease in engine weight are sought. A concurrent goal in one embodiment is increased torsional rigidity.

According to the present invention, mechanically detachable rotor blades of a gas turbine engine are formed in unitized pairs having high strength, high modulus, continuous fibers running from the tip of one blade to the tip of the adjacent paired blade.

A primary feature of the present invention is the blade assembly comprising a unitized pair of composite blades. The blade retention technique taught is well suited to preferred fiber orientations within a composite structure. A core of continuous fibers extends from the tip of one blade to the tip of the adjacent paired blade. A generous bend radius for the fiber core is provided around the central platform block of the blade assembly. A shell, which in one embodiment comprises adjacent layers of biased fibers, encases each end of the fiber core to form the airfoil shaped portion of the blades. One embodiment of the invention includes a circumferentially extending blade tip shroud having a metallic knife-edge embedded therein for sealing between the engine rotor and stator.

A principal advantage of the present invention is improved engine performance. The extensive use of composite materials reduces the weight of the engine rotor. The reduced weight of the rotor enables increased engine speeds without imparting excessive centrifugally induced forces to the rotor components. Torsional rigidity is provided in one embodiment in which crossing layers of fibers form the airfoil shaped shells. Aerodynamic performance is improved by eliminating the necessity of a midspan shroud on fan blades incorporating the concepts taught herein. Each paired blade assembly is mechanically detachable from the rotor to enable replacement of individual blade assemblies. In one embodiment, additional torsional rigidity is added to the assembly through the incorporation of a blade tip shroud.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 5 is an end sectional view taken through a portion of the rotor assembly of a gas turbine engine showing an alternative embodiment to that shown in FIG. 1; and FIG. 6 is a sectional view taken along the line 6—6 as shown in FIG. 5.

DESCRIPTION OF THE PREFERRED EMBODIMENTS

Figure 1:
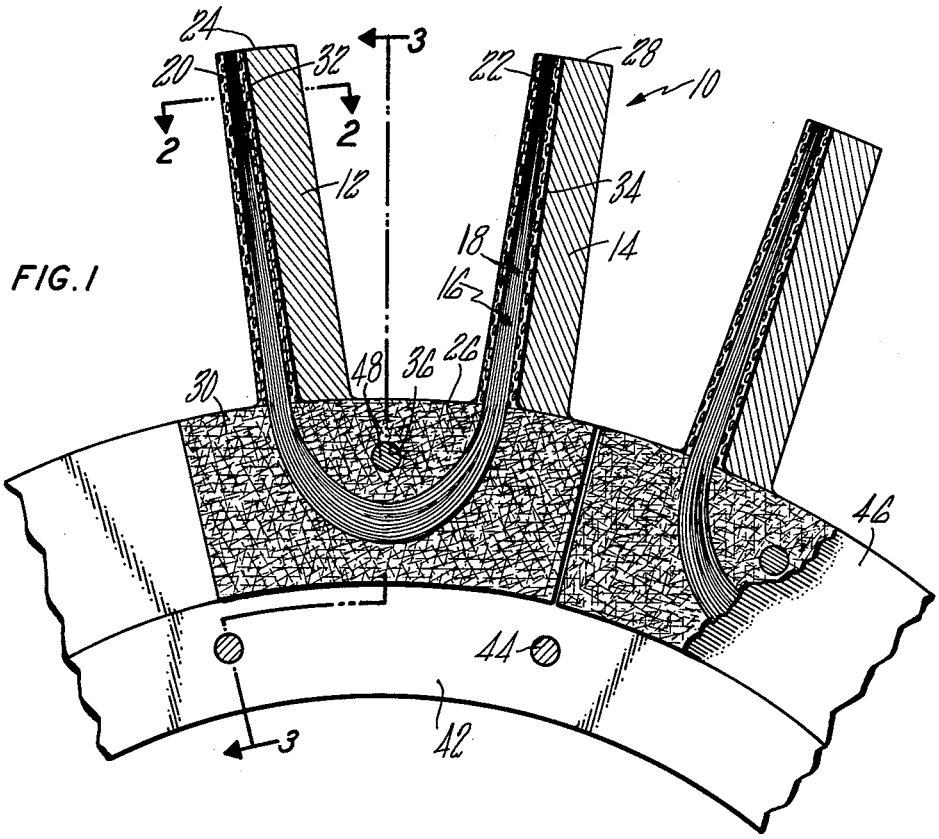
FIG. 1 is an end cross-sectional view taken through a portion of the rotor assembly of a gas turbine engine.
Figure 2:
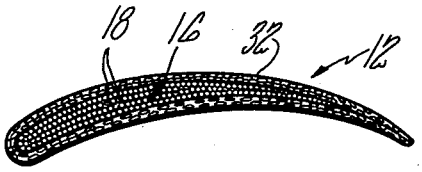
FIG. 2 is a sectional view taken along the line 2—2 as shown in FIG. 1.

A paired blade assembly 10 which is suitable for use in a gas turbine engine is shown in partial cross section in FIG. 1. Each blade assembly is a unitized structure having a first blade 12 and an adjacent, second blade 14. A core 16 of continuous fibers 18 has a first end 20 and an opposite end 22. The core extends from the tip 24 of the first blade around a central platform block 26 to the tip 28 of the adjacent, second blade. An outer platform block 30 forms the base of the blade assembly. The core of continuous fibers is trapped between the central platform block and the outer platform block. A first shell 32 having an airfoil shaped contour encases the first end 20 of the core of continuous fibers to form the first blade 12. A second shell 34 having an airfoil shaped contour encases the opposite end 22 of the core of continuous fibers to form the adjacent, second blade 14. A thru hole 36 penetrates the central platform block and is adapted to receive rotor retaining means.

Figure 3:
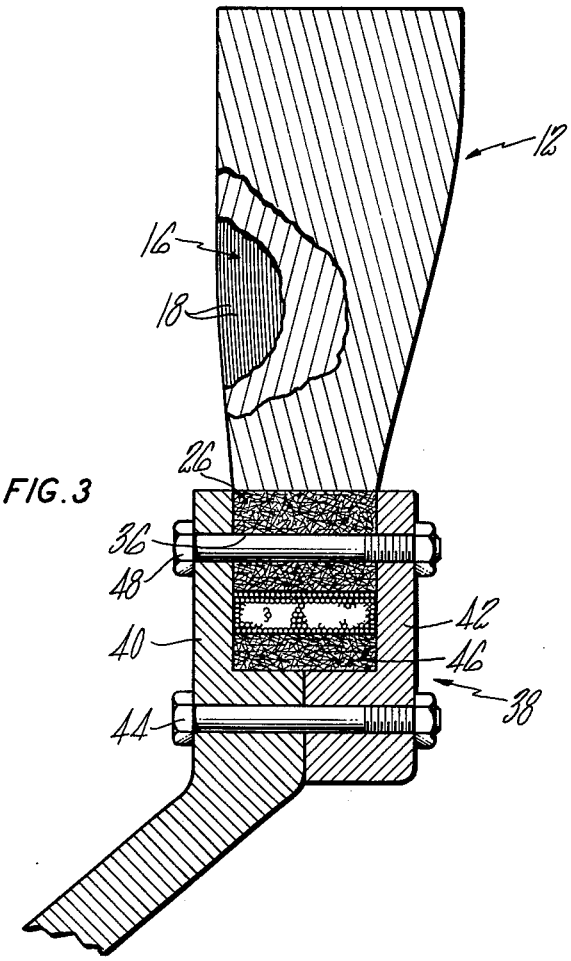
FIG. 3 is a sectional view taken along the line 3—3 as shown in FIG. 1.

A plurality of the paired blade assemblies 10 is disposed in circumferentially adjacent relationship about the rotor of an engine to form a compression stage. A cross section view of such a rotor stage is shown in FIG. 3. The rotor includes a disk 38 having a front plate 40 and a rear plate 42. The front and rear plates are secured in abutting relationship by a bolt 44. The plates are contoured so as to form an outwardly facing, circumferentially extending channel 46 therebetween. A plurality of the blade assemblies 10 is disposed in adjacent relationship within the channel. The base of each blade assembly is secured therein by a retaining pin 48 which penetrates the thru hole 36 of the central platform block 26. Each paired blade assembly is mechanically detachable from the rotor assembly.

The core 16 of continuous fibers 18 is formed of a multiplicity of parallel fibers embedded in a matrix. A fiber/matrix system comprising boron fibers embedded in an aluminum matrix provides an effective embodiment, although other fiber/matrix systems which are compatible with the intended environment will produce effective structures. The fibers of the core run from the tip 24 of the first blade around the central platform block 26 to the tip 28 of the adjacent, second blade. During operation of the engine in which the blade assembly is installed, the fibers of the core carry the predominant portion of the centrifugally generated tensile loads within the blade assembly.

The first shell and the second shell may be fabricated from either metallic or composite materials. In one particularly effective embodiment, the shells are fabricated of composite materials and include crossing layers of parallel fibers. As in the case with the central core, a boron fiber and carbon matrix system produce an effective structure although fiber/matrix systems having similar physical properties can be expected to produce comparable embodiments. The layers of crossing fibers add torsional rigidity to the structure.

The central platform block and the outer platform block are also fabricated from fiber/matrix systems. Chopped fiber structures are selected for the central and outer platform blocks to add multidirectional strength to the block material.

Figure 4:
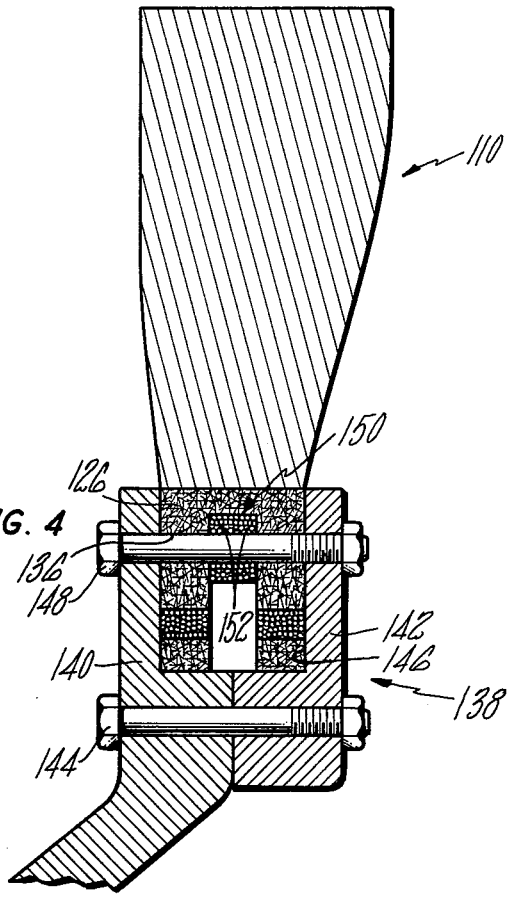
FIG. 4 is a sectional view of an alternate embodiment having a rotor reinforced with a composite hoop.

A cross-sectional view of an alternate embodiment of the rotor stage is shown in FIG. 4. The rotor includes a disk 138 having a front plate 140 and a rear plate 142. The front and rear plates are secured in abutting relationship by a bolt 144. The plates are contoured so as to form an outwardly facing, circumferentially extending channel 146 therebetween. A plurality of the paired blade assemblies 110 is disposed in circumferential adjacent relationship within the channel. The base of each blade assembly is secured therein by a retaining pin 148 which penetrates a thru hole 136 in the central platform block 126.

A reinforcing hoop 150 of continuous fibers 152 is disposed within the channel 146. The reinforcing hoop engages each retaining pin 148, for example, and carries a substantial portion of the loads imparted to the disk by the blade assemblies during operation. The reinforcing ring is formed of boron fibers embedded in an aluminum matrix although other fiber/matrix systems which are compatible with the intended environment will produce effective structures.

The apparatus of the present invention is adapted in another embodiment to a shrouded blade construction as is shown in FIG. 5. A shrouded blade assembly 210 has a first blade 212 and an adjacent, second blade 214. A core 216 of continuous fibers 218 extends from the tip 224 of the first blade around a central platform block 226 to the tip 228 of the adjacent, second blade. An outer platform block 230 forms the base of the assembly. The core of continuous fibers is trapped between the central platform block and the outer platform block. A thru hole 236 penetrates the central platform block and is adapted to receive rotor retaining means. A plurality of the paired blade assemblies 210 is disposed in circumferentially adjacent relationship to form a compression stage. A central shell 250 having a substantially trapezoidal cross section covers the opposing faces of the adjacent paired blades to form the facing surfaces of the airfoil sections. A first end shell 252 covers the opposite surface of one airfoil section to complete the first blade 212. A second end shell 254 covers the opposite surface of the other airfoil section to complete the adjacent, second blade 214. A composite shroud 256 which is formed of circumferentially extending, parallel fibers 258 extends over the tips of the paired first and second blades.

In the embodiment shown a metallic knife-edge element 260 which forms one side of a labyrinth seal is embedded in the composite shroud. The metallic knife-edge element has a first tab 262 which extends into the first blade and a second tab 264 which extends into the adjacent, second blade to hold the knife-edge element in the assembly. A plurality of parallel knife-edge elements may be similarly embedded in the composite shroud 256 where staged labyrinth sealing is desired. The shrouded construction has substantially increased torsional rigidity and excellent resistance to blade "flutter".

Composite materials are used extensively in the embodiments of the present invention. Composite materials offer increased strength to weight ratios when compared to more conventional, metallic materials. Engine performance is improved by the decrease in component weight. Increased rotor blade tip speeds are employable within the strength limits of the fiber system selected.

Notwithstanding the general desirability of composite materials, metallic elements may be utilized in some embodiments. One effective use of metallic materials, reducing the susceptibility of the blades to foreign object damage, is in the airfoil shaped shells which encase the fibrous core.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of my invention, that which I claim as new and desire to secure by Letters Patent of the United States is:

1. A rotor assembly for a gas turbine engine, which comprises:

a rotor disk having a front plate and a rear plate which are contoured to form an outwardly facing circumferentially extending channel therebetween; and a plurality of unitized blade assemblies mounted in and extending outwardly from said channel, each assembly including a central platform block adapted for mechanical attachment to the rotor disk, a core of continuous fibers having a central portion which extends around said platform block, and having a first end and an opposite end which extend outwardly from said block in essentially the same direction;

an outer platform block adapted to hold, in cooperation with the central platform block, the central portion of the core of continuous fibers therebetween;

a first shell having an airfoil-shaped contour which encases said first end of the core of continuous fibers to form a first rotor blade; and a second shell having an airfoil-shaped contour which engages said opposite end of the core of continuous fibers to form a second rotor blade.

2. The invention according to claim 1 which further includes a reinforcing ring of continuous fibers extending circumferentially about the rotor disk of said assembly and adapted to carry a substantial portion of the centrifugally generated hoop stresses imparted to the disk by the blades of the assembly during rotation.

* * * * *